US006142050A

United States Patent [19]

Miki

[11] Patent Number: 6,142,050

[45] **Date of Patent: *Nov. 7, 2000**

[54] CUTTING MACHINE FOR ELONGATE WORKPIECES

[75] Inventor: Tokukazu Miki, Tokyo, Japan

[73] Assignee: Kabushiki Kaisha Sankoh Seisakusho, Saitama-Ken, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/970,593

[22] Filed: Nov. 14, 1997

Related U.S. Application Data

[63] Continuation of application No. 08/490,321, Jun. 14, 1995, abandoned.

[30] Foreign Application Priority Data

Jun. 15, 1994 [JP] Japan ..... 6-133384

[51] Int. Cl.[7] ..... B26D 7/06

[52] U.S. Cl. ..... 83/425.2; 83/418; 83/435.11; 83/435.17; 83/437.1; 83/435.22; 83/437.3; 83/452; 83/468.6; 83/155; 83/157

[58] Field of Search ..... 83/409, 415, 418, 83/425, 425.2, 435.11, 437.1, 155, 157, 113, 156, 436.3, 452, 467.1, 468.6, 431, 432, 435.22, 437.3, 435.17

[56] References Cited

U.S. PATENT DOCUMENTS

| | | | |
|---|---|---|---|
| 1,063,914 | 6/1913 | Dehlin | 83/415 X |
| 1,969,425 | 8/1934 | Richardson | 83/425.2 X |
| 3,310,080 | 3/1967 | Delcellier | 83/425 X |
| 3,538,963 | 11/1970 | Adams | 83/415 X |
| 3,830,121 | 8/1974 | Makeev et al. | 83/415 X |
| 3,889,560 | 6/1975 | MacFadyen | 83/425 X |
| 3,943,808 | 3/1976 | Pryor et al. . | |
| 4,023,605 | 5/1977 | Hellström et al. . | |
| 4,093,007 | 6/1978 | Hellström . | |
| 4,120,333 | 10/1978 | Hellgren et al. . | |
| 4,173,238 | 11/1979 | Pryor et al. . | |
| 4,269,245 | 5/1981 | Fornell et al. | 83/425 X |
| 4,277,998 | 7/1981 | Mayo . | |
| 4,468,992 | 9/1984 | McGeehee . | |
| 4,676,129 | 6/1987 | Blanco . | |
| 4,683,789 | 8/1987 | Lopez | 83/415 X |
| 4,770,076 | 9/1988 | Wilson . | |
| 4,829,865 | 5/1989 | Nunnery et al. . | |
| 5,002,108 | 3/1991 | Jenkner | 83/409 X |
| 5,088,363 | 2/1992 | Jones et al. . | |
| 5,142,955 | 9/1992 | Hale . | |
| 5,249,491 | 10/1993 | Carter . | |
| 5,381,712 | 1/1995 | Head, Jr. et al. | 83/425.2 X |
| 5,417,265 | 5/1995 | Davenport et al. | 83/425 X |

FOREIGN PATENT DOCUMENTS

| | | | |
|---|---|---|---|
| 2810983 | 9/1979 | Germany | 83/425.2 |
| 0112902 | 4/1990 | Japan | 83/418 X |

*Primary Examiner*—Rinaldi I. Rada
*Assistant Examiner*—Boyer Ashley
*Attorney, Agent, or Firm*—Christensen O'Connor Johnson Kindness PLLC

[57] ABSTRACT

A cutting machine (A) simultaneously cuts an elongate workpiece (a) into one or more building products, wherein each product is of a predetermined length. The machine includes a frame or foundation (1), which supports an input or carry-in conveyor (2) for conveying the workpiece along a first path of travel. The machine further includes a plurality of cutting mechanisms (3), (5), (6), and (7) and a feed mechanism (12) supported on the frame. At least some of the cutting mechanisms are movably mounted on the frame for selectively adjusting the spacing between adjacent cutting mechanisms for cutting the workpiece into products of predetermined length or lengths. The feed mechanism receives the workpiece from the input conveyor and moves the workpiece along a second path of travel until the workpiece contacts the cutting mechanisms, thereby cutting the workpiece.

17 Claims, 4 Drawing Sheets

CUTTING MACHINE FOR ELONGATE WORKPIECES

This application is a continuation application of application Ser. No. 08/490,321, filed on Jun. 14, 1995 now abandoned.

FIELD OF THE INVENTION

The present invention is directed to the cutting of building materials, and more particularly, to the cutting of building materials to obtain products having a predetermined length.

BACKGROUND OF THE INVENTION

Building materials of predetermined lengths are frequently cut from elongate workpieces, also known as beams. Typically, the workpieces are made of wood or wood laminates, aluminum, or plastic, such as plastic laminate formed from polyvinyl chloride.

The most common way for cutting a workpiece into one or more predetermined lengths is to first trim one end of the workpiece to a satisfactory shape. The predetermined length or lengths is then measured relative to the shaped end for cutting. Typically, a circular saw machine or a band saw machine is used for the cutting. However, since these saw machines are not dedicated to cutting workpieces to predetermined lengths, the use of such machines in the foregoing way is extremely inefficient and laborious because a number of machining processes and manual operations are required.

An attempted solution in increasing the efficiency of using circular saw or band saw machines in cutting workpieces to predetermined lengths is the conventional cutting apparatus 105 shown in FIG. 6. Specifically, the finishing apparatus 105 includes two circular saws 101 and 102, which are adapted to be installed in parallel with their rotating surfaces being spaced apart by a predetermined distance L. A workpiece 103 is fed into the apparatus 105 along split lines of cutting circumferences of the circular saws 101 and 102 for simultaneously cutting both ends of the workpiece 103 to obtain building material of a predetermined length. With the conventional apparatus 105, a sequence of operations including feeding, cutting and discharge of a material are all mechanically associated with each other and sequentially performed on the same plane and in the same direction.

In the conventional apparatus 105, the workpiece 103 is supported by a pair of dogs 111 and 112 protrusively formed on two chain conveyers 109 and 110 which are disposed in a parallel, spaced-apart relationship. For cutting the workpiece 103 to form end surfaces 106 and 107 perpendicular to the major axis 108, the workpiece 103 must be supported so as to constantly direct the major axis 108 perpendicular to the rotating surfaces of circular saws 101 and 102.

To do so, the dogs 111 and 112 supporting the workpiece 103 at both ends thereof must always be kept in-phase. For preventing the dogs 111 and 112 from falling into an out-of-phase condition, driving chain wheels 115 and 116 for driving the two chain conveyers 109 and 110 are linked by a rigid shaft 118 having a key groove 117. However, the dogs 111 and 112 may be displaced due to unequal stretching of the chain conveyers 109 and 110 over time. Thus, it is necessary to adjust the positions of the dogs 111 and 112 at relatively frequent intervals to compensate for unequal stretching of the chain conveyers 109 and 110. Furthermore, since these machine elements are all mechanically linked with each other and mutually act in association, adjustment of the dogs 111 and 112 is not easily carried out.

Also, in the conventional apparatus 105 as described above, the workpiece 103 should be clamped during a cutting operation so as to prevent the workpiece 103 from displacing. Thus, forces in the feeding direction and the vertical direction must be always applied to the workpiece 103 while it is being fed into the apparatus 105. For applying such forces to the workpiece 103, a pair of belt conveyers 113 and 114 are provided, which apply downward vertical forces and simultaneously move in a direction parallel to the urging direction. Thus, the belt conveyers 113 and 114 must extend over the whole region of the cutting process and run at the same speed as the chain conveyers 109 and 110. Additionally, since the two chain wheels 115 and 116 are linked together by the rigid shaft 118 having the key groove 117 in order to rotate them in-phase, the whole structure of the apparatus 105 is necessarily large and bulky.

Moreover, often it is desired cut a workpiece 103 into two or more pieces of different lengths, for example, a vertical member and a horizontal member for a door. The conventional cutting apparatus 105 cannot simultaneously cut a single workpiece 103 into a plurality of pieces having different lengths.

Additionally, the conventional cutting apparatus 105 cannot precisely cut a workpiece 103 orthogonal to the major axis 108 of the workpiece to obtain a finished building material product of a predetermined length. More particularly, when a building material product is cut to a satisfactory size and shape, requiring no further machining or cutting, the product is said to be "finished." Referring to FIG. 7(*a*), the chain conveyors 109 and 110 convey the workpiece 103 in the direction indicated by the arrows for cutting by the circular saw 101. As the chain conveyors 109 and 110 convey the workpiece 103 past the circular saw 101, the saw cuts the workpiece.

To obtain a finished product, the circular saw 101 must be tilted by a small angle a relative to a cutting line c to maintain a small gap $\delta$ between the cutting line c and a tail end 101*b* of the circular saw 101 as shown in FIG. 7(*b*). Otherwise, a cut surface 103*a* having been cut by a leading end 101*a* of the circular saw 101 would be contacted again by the tail end 101*b* of the circular saw 101 and roughed thereby. Tilting the circular saw 101 by the angle $\alpha$ causes the cut surface 103*a*' of the workpiece 103' on the other side of the circular saw 101 to be roughed.

Also, the conventional apparatus 105 is not capable of obliquely cutting a workpiece at a substantial angle. Hence, the conventional apparatus 105 has several drawbacks that are especially disadvantageous for industrial use.

The present invention provides an improved solution for cutting building products of different lengths from elongate workpieces.

SUMMARY OF THE INVENTION

The present invention provides a machine for cutting an elongate workpiece having first and second ends. The machine includes a frame, which supports an input or carry-in conveyor for conveying the workpiece along a first path of travel. The frame further supports a first cutting mechanism and a second cutting mechanism spaced from the first cutting mechanism. A transfer conveyor is supported on the frame for conveying the workpiece along a second path of travel from the input conveyor to substantially below the first and second cutting mechanisms. The second path of travel is substantially orthogonal to the first path of travel. A feed mechanism is also supported on the frame for receiving the workpiece from the transfer conveyor and moving the workpiece along a third path of travel until the workpiece contacts the first and second cutting mechanisms, thereby cutting the workpiece in two locations.

Preferably, the frame supports at least three cutting mechanisms for cutting the workpiece into a plurality of products when the feed mechanism moves the workpiece along the third path of travel. Further, one or more of the cutting mechanisms movably mount to the frame for selectively adjusting the spacing between adjacent cutting mechanisms for cutting the workpiece into products of predetermined lengths. Additionally, one or more of the cutting mechanisms are movable from a cutting position along the third path of travel, to a disengaged position removed from the path of travel. When the cutting mechanism or mechanisms are moved to the disengaged position, these mechanisms do not contact, and thus do not cut the workpiece when the feed mechanism moves the workpiece along the third path of travel.

Additionally, the machine includes a plurality of transfer conveyors for receiving the workpiece from the input conveyor and moving the workpiece along the second path of travel for receipt by the feed mechanism. At least one of the transfer conveyors movably mount to the frame for selectively adjusting the distance between the first transfer conveyor and at least one other transfer conveyor.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein:

FIG. 1 (*b*) is a front view of the cutting machine of FIG. 1(*a*);

DETAILED DESCRIPTION OF THE PREFERRED EMBODIMENT

Figure 1A:
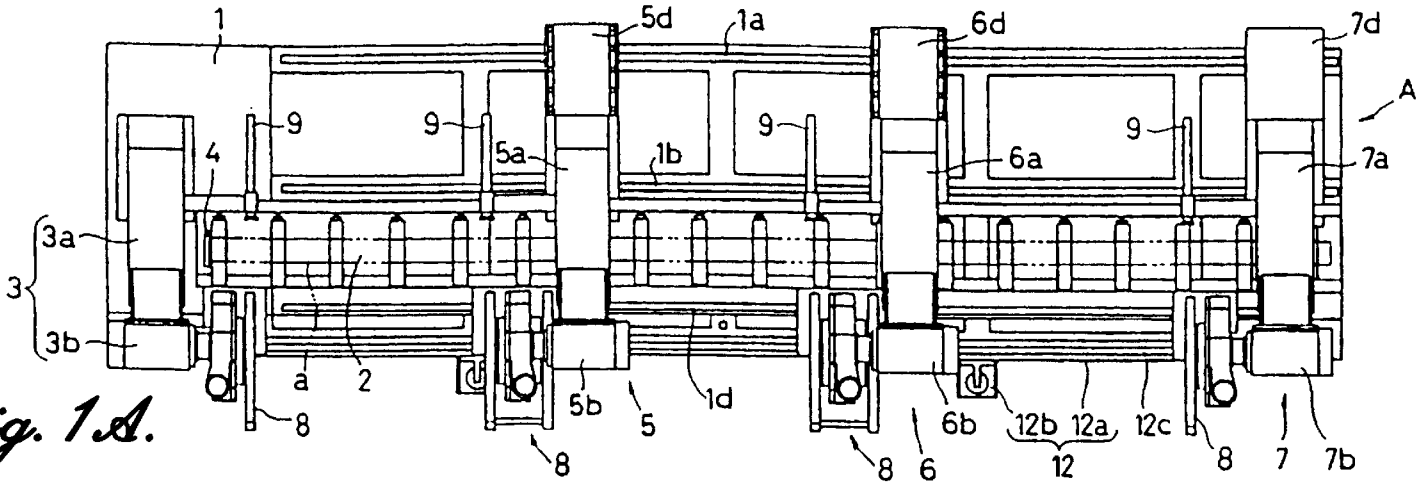
FIG. 1(*a*) is a top plan view of a preferred embodiment of a cutting machine in accordance with the present invention.
Figure 1B:
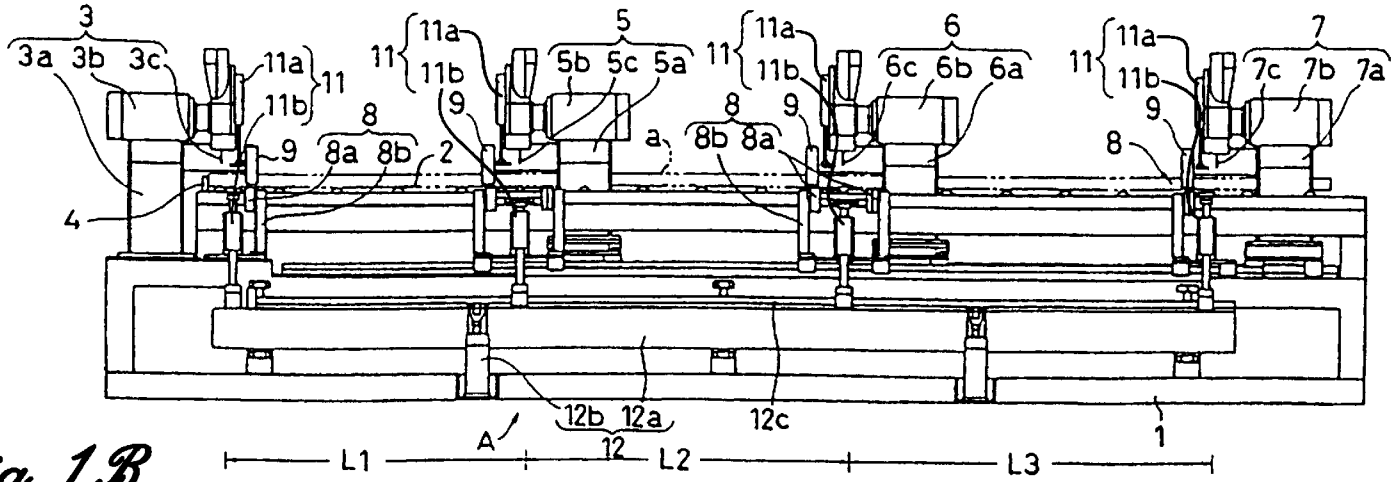
Figure 2:
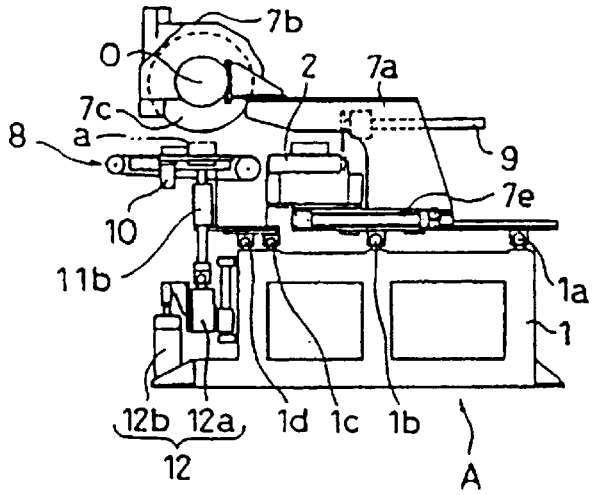
FIG. 2 is a side view of the cutting machine of FIG. 1(*a*)

FIG. 1(*a*) illustrates a preferred embodiment of a cutting machine A in accordance with the present invention. The cutting machine A includes a frame or foundation 1 adapted to support the entire machine. A plurality of generally parallel, longitudinally extending rails 1*a*, 1*b*, 1*c*, and I*d* having substantially circular cross-sections are provided along the top of the foundation 1 as shown in FIG. 2. An input or carry-in conveyor 2 extends along one side of the foundation 1, generally parallel to the rails 1*a*, 1*b*, 1*c*, and 1*d*. The conveyor 2 is similar in construction to conventional conveyors of the type having a plurality of substantially parallel rollers positioned at generally equal intervals and driven by a motor to rotate at an equal speed in the same direction for transporting articles from roller-to-roller.

As viewed in the figures, a cutter head 3 is stationarily provided on the left end of the foundation 1. The cutter head 3 comprises a stand 3*a* supporting a head body 3*b*. The head body 3*b* includes a circular saw rotatably driven by an electric motor, and a cover partially surrounding the circular saw. One end of the carry-in conveyor 2 is proximate the cutter head 3. A plate-like stopper 4 is positioned between the end of the carry-in conveyor and the cutter head 3. The carry-in conveyor 2 conveys elongate workpieces, such as workpiece a, longitudinally along the length of the conveyor towards the cutter head 3. When the end of such a workpiece strikes the stopper 4, a limit switch (not shown) activates and stops the carry-in conveyor 2.

Referring to FIG. 1(*b*), the machine A includes three other cutter heads 5, 6, and 7 spaced longitudinally along the foundation 1. The cutter heads 5, 6, and 7 each include stands 5*a*, 6*a*, and 7*a*, wherein each stand has an inverted L-shape in side view (see FIG. 2). Movable bases 5*d*, 6*d*, and 7*d* respectively support the stands 5*a*, 6*a*, and 7*d*, and slidably connect through ball splines to the rails 1*a* and 1*b* of the foundation 1 so that each base smoothly slides along the rails as shown in FIG. 1(*b*). A forward end of each of the stands 5*a*, 6*a*, and 7*a* is located above the side of the carry-in conveyor 2 opposite the side of the foundation 1 the carry-in conveyor extends along. The forward ends of each of the stands 5*a*, 6*a*, and 7*a* respectively support a cutter head body 5*b*, 6*b*, and 7*b* including respective circular saws 5*c*, 6*c*, and 7*c* and an electric motor powering each saw. The circular saws 3*c*, 5*c*, 6*c*, and 7*c* are all of substantially the same diameter and each saw has a cutting point located below its central axis, substantially aligned with the cutting points of the other saws along a straight line.

Preferably, the stands 5*a*, 6*a*, and 7*a* are each slidable within their respective bases 5*d*, 6*d*, and 7*d* in a directional transverse to the longitudinal axis of the carry-in conveyor 2. Referring to FIG. 2, each stand 5*a*, 6*a*, and 7*a* connects to an air cylinder which moves the stands back and forth transversely to the longitudinal axis of the carry-in conveyor. While FIG. 2 shows only the air cylinder 7*e* for the cutter head 7, it should be understood that the other cutter heads 5, 6 are also each provided with a similar air cylinder. The arrangement as has been described above allows the cutter heads 5, 6, 7 to move longitudinally on the bases 5*d*, 6*d*, and 7*d*along the rails 1*a* and 1*b*, and also substantially orthogonal to the longitudinal axis of the carry-in conveyor 2. However, it is not essential for these cutter heads 5, 6, 7 to be movable orthogonally to the carry-in conveyor 2.

Figure 3:
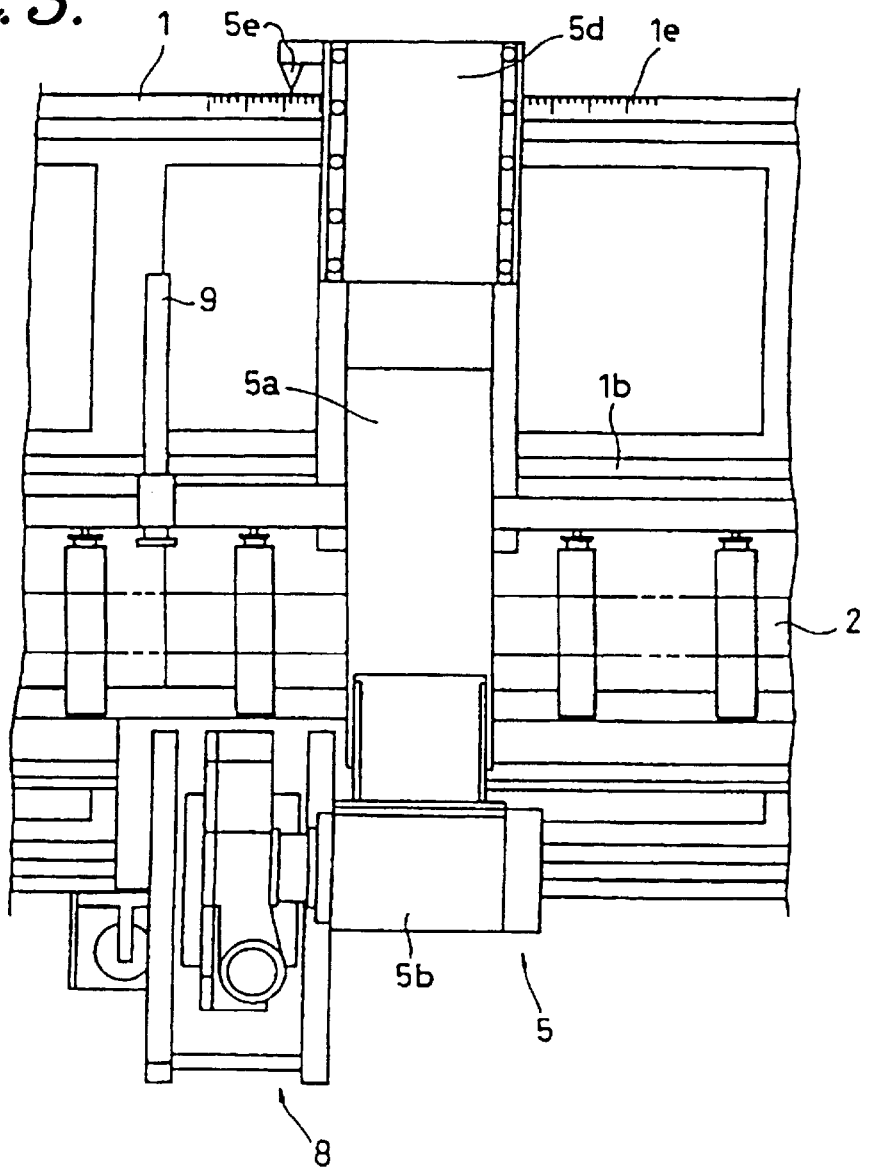
FIG. 3 is an enlarged top plan view of part of the cutting machine of FIG. 1(*a*)

Referring to FIG. 3, preferably a scale 1*e* is provided longitudinally along the foundation 1 and an index 5*e* on the cutter head 5 in association with the scale 1*e* so that a distance from the cutting plane of the cutter head 3 to the cutting plane of the cutter head 5 may be read. Though not shown, the other cutter heads 6 and 7 also preferably have such indices so that distances L1, L2, L3 as shown in FIG. 1(*b*) between the circular saws associated of adjacent cutter heads 3, 5, 6, 7 may be accurately selected.

A transfer conveyor 8 is operatively associated with each cutter head 3, 5, 6 and 7. The transfer conveyors 8 transfer a workpiece transversely from (in the case of the preferred embodiment, orthogonally from) the direction in which the carry-in conveyor 2 transports the workpiece (from right to left as viewed in FIG. 1). The transfer conveyors 8 each include a belt 8*a* as shown in FIG. 1(*b*). The conveyors 8 associated with the end cutter heads 3 and 7 each include a single belt 8*a*, while the conveyors associated with the intermediate cutter heads 5 each 6 each include a pair of such belts. Ball splines slidably connect supporting frames

8*b* for each transfer conveyor 8 to the rails 1*c* and 1*d*, so that the transfer conveyors are slidable along the rails.

Switching mechanisms 9 associated with each cutter head 3, 5, 6 and 7 shift a workpiece from the carry-in conveyor 2 to the transfer conveyors 8. Each switching mechanism 9 is powered by an air cylinder. The switching mechanisms 9 move workpieces in the same direction as the transfer conveyors 8. Accordingly, it is possible to devise an arrangement in which the switching mechanisms 9 or the transfer conveyors 8 are eliminated. For example, the stroke of the switching mechanisms 9 can be increased sufficiently, such that the transfer conveyor 8 can be eliminated, or alternatively, the length of the transfer conveyors 8 can be increased such that the switching mechanisms can be eliminated. However, provision of the switching mechanisms 9 advantageously allows the transfer conveyors 8 to be spaced from the carry-in conveyor 2 and thereby allows the machine A to be designed at a relatively high degree of freedom.

Referring to FIG. 2, transverse stoppers 10 function to stop the movement of a workpiece along the transfer conveyors 8. In the preferred embodiment, the stoppers 10 comprise air cylinders each having an upper end movable between an upper position and a lower position. When the ends of the air cylinders are in the upper position, the upper ends project above the conveying plane of an associated belt 8*a*. Thus a workpiece moving along the transfer conveyors 8, impacts the upper ends of the air cylinders, which prevents the workpiece from moving further along the transfer conveyors. In the lower position, the upper ends of the air cylinders retract below the conveying plane and allow the workpiece to move further along the transfer conveyors 8.

The above-mentioned transfer conveyors 8 and switching mechanisms 9 cooperate with one another to transversely position workpieces on the machine A, which have already positioned longitudinally on the machine A by the carry-in conveyor 2. For this reason, each transfer conveyor 8 and associated switching mechanism 9 will be referred to hereinafter generally as a transfer mechanism.

Referring to FIGS. 1(*b*) and 2, a holding mechanism 11 is associated with each cutter head 3, 5, 6 and 7 for holding a workpiece. Each holding mechanism 11 includes an upper cylinder 11*a* and a lower stand 11*b*. Each upper cylinder 11*a* is fixed to its respective cutter head 3, 5, 6, or 7 at a position so that the upper cylinder 11*a* is substantially parallel to a diagonal passing downwardly through the center of the circular saw 3*c*, 5*c*, 6*c*, or 7*c* associated with this cutter head. The lower stand 11*b* is fixed to one side of the transfer conveyor 8 associated with that cutter head 3, 5, 6, or 7. More particularly, each lower stand 11*b* is immediately below a corresponding upper cylinder 11*a*.

When a workpiece conveyed by the transfer conveyors 8 is stopped by the transverse stoppers 10, the workpiece is positioned just below the cutting points of the cutter heads 3, 5, 6, and 7. In this position, the longitudinal axis of the workpiece lies substantially parallel to a line connecting the centers of the stands 11*b*. Thereafter, pistons descend from the each of the upper cylinders 11*a* to clamp and thereby fix the workpiece against the stands 11*b*. The transverse stoppers 10 are adjustably moved in the direction in which the transfer conveyors 8 operate in response to a change in transverse dimension (i.e., width) of the workpiece so that the center of the workpiece may be always aligned with the line connecting the centers of the circular saws 3*c*, 5*c*, 6*c*, and 7*c*.

The machine A includes a feed mechanism 12 extending along the longitudinal side of the foundation 1 underneath the holding mechanisms 11 as shown in FIGS. 1(*b*) and 2. The feed mechanism 12 includes a lifting rail 12*a* and a pair of spaced apart air cylinders 12*b* positioned below the lifting rail for raising and lowering the lifting rail 12*a*. The lifting rail 12*a* includes a rail 12*c* extending along the upper length of the lifting rail, to which the previously mentioned stands 11*b* are movably mounted. Specifically, ball bushings movably support the stands 11*b* on the rail 12*c*. The air cylinders 12*b* are provided adjacent longitudinally opposite ends of the lifting rail 12*a* so as to be spaced from each other. The raising and lowering speed of each air cylinder 12*b* may be adjusted to maintain the lifting rail 12*a* generally horizontal and generally parallel to a line connecting the cutting points of the cutting heads 3, 5, 6, and 7, and thereby facilitate ascent and descent of the lifting rail 12*a*. By raising and lowering the single lifting rail 12*a* with the air cylinders 12*b* in this manner, the workpiece can be more easily lifted in a horizontal orientation, as opposed to where a plurality of feed mechanisms 12 are separately lifted.

Figure 4:
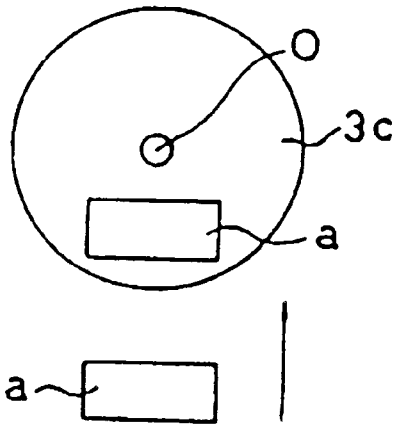
FIG. 4 is a schematic diagram illustrating a preferred embodiment of a method of cutting in accordance with the present invention.

FIG. 4 is a schematic end view illustrating the manner in which the machine A cuts a workpiece. In particular, the machine A moves a workpiece radially towards the center 0 of each circular saw 3*c*, 5*c*, 6*c*, and 7*c*, i.e., substantially along a direction of travel normal to the circular saws. The circular saws 3*c*, 5*c*, 6*c*, and 7*c* complete cutting of the workpiece before the workpiece reaches the center 0 of the circular saws. With this method of cutting, there is no apprehension that the end surface having been cut by the leading end of the circular saw might be contacted again by the tail end of the same circular saw and consequently roughed. In this manner, each cut end of the workpiece present smooth surfaces. In comparison, the previously described conventional manner of cutting forms a rough cut end for every smooth cut end of a workpiece.

The operational sequence of the machine A is as follows: Prior to cutting, the scaled indices 5*e* (see FIG. 3) of the cutter heads are set to position the cutter heads 5, 6, and 7 to achieve desired lengths L1, L2, and L3 (see FIG. 1*b*). When only two finished lengths of a building material are desired, one of the cutter heads 5, 6, or 7 is selectively retracted by associated retraction means, such as the air cylinder 7*e* (see FIG. 2). When a single length of a building material is desired, two of the cutter heads are selectively retracted. It should be understood that the transfer conveyors 8, the switching mechanisms 9 and the holding mechanisms 11 are moved integrally with the respective cutter heads, as the cutter heads are moved.

Thereafter, a workpiece, such as house timber, is longitudinally conveyed by the carry-in conveyor 2 from right to left as viewed in FIG. 1. The workpiece is stopped and positioned longitudinally on the cutting machine A when the forward end of the workpiece bears against the longitudinal stopper 4. Next, the air cylinders of the switching mechanisms 9 operate to move the workpiece from the carry-in conveyor 2 to the transfer conveyors 8. At this juncture, each transverse stopper 10 projects above the conveying plane of its associated transfer conveyor 8. The transverse conveyors 8 transversely convey the workpiece until a lateral surface of the workpiece contacts the transverse stoppers 10. As best seen in FIG. 2, the workpiece is thus positioned by the transverse stoppers 10 above the stands 11*b* immediately below a common axis 0 of the cutter heads 3, 5, 6, and 7. The transverse stoppers 10 associated with the respective cutter heads can be easily aligned with one another.

Thereafter, the pistons descend from the upper cylinders 11*a* of each holding mechanism 11, and cooperate with the associated stands 11*b* to clamp the workpiece therebetween. Subsequently, the air cylinders 12*b* on opposite sides of the feed mechanism 12 simultaneously actuate to move the lifting rail 12*a* upward. Force exerted by the air cylinders 12*b* of the feed mechanism 12 on a workpiece is designed to be higher than the force exerted by the upper cylinders 11*a* of the holding mechanisms 11 so that the air cylinders 12*b* lift the workpiece towards the common axis 0 of the circular saws 3*c*, 5*c*, 6*c*, and 7*c*. The circular saws 3*c*, 5*c*, 6*c*, and 7*c* begin to cut the workpiece when it reaches the peripheral bottoms of the circular saws, and cutting is completed before the top surface of the workpiece reaches the center 0 of each of the circular saws. Cutting takes place closely adjacent a holding mechanism 11 so that there is no apprehension that the workpiece might be displaced due to vibration and shock from cutting.

When the cutting completes, the pistons or similar members retract into the air cylinders 12*b* of the feed mechanism 12 to place the cut workpiece back into contact with the top surfaces of the transfer conveyors 8, while the holding mechanisms 11 continue to hold the cut workpiece. Next, the pistons in the upper cylinders 11*a* of the holding mechanisms 11 retract upward and release the workpiece. By this time, the transverse stoppers 10 have also retracted, allowing the transfer conveyors 8 to discharge the cut workpiece from the cutting machine A. The cut workpiece is thus discharged in the form of pieces having lengths predetermined by the distances L1, L2, and L3. The belts 8*a* of the transfer conveyors 8 support these pieces at their longitudinal opposite ends.

Figure 5:
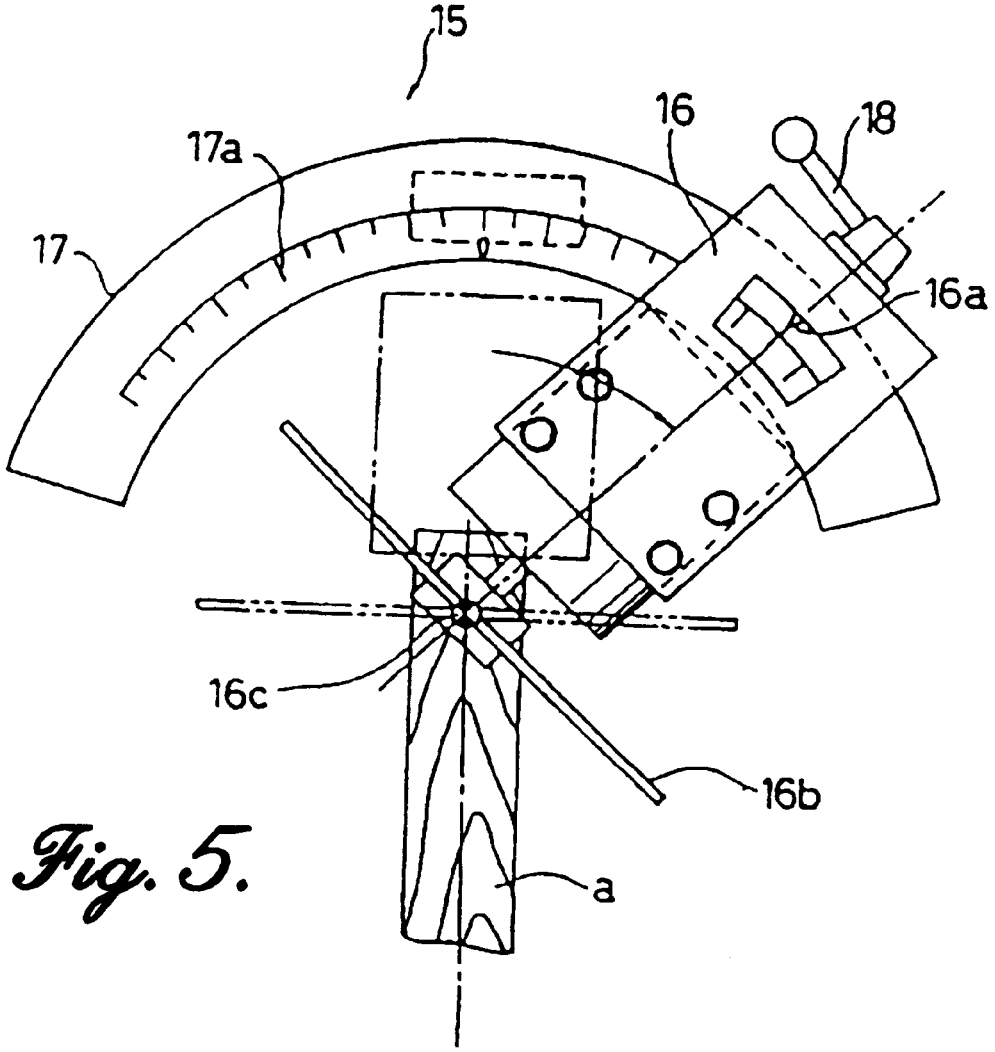
FIG. 5 is a top view of an alternate embodiment of a cutting head in accordance with the present invention for the cutting machine of FIG. 1(*a*)
Figure 6:
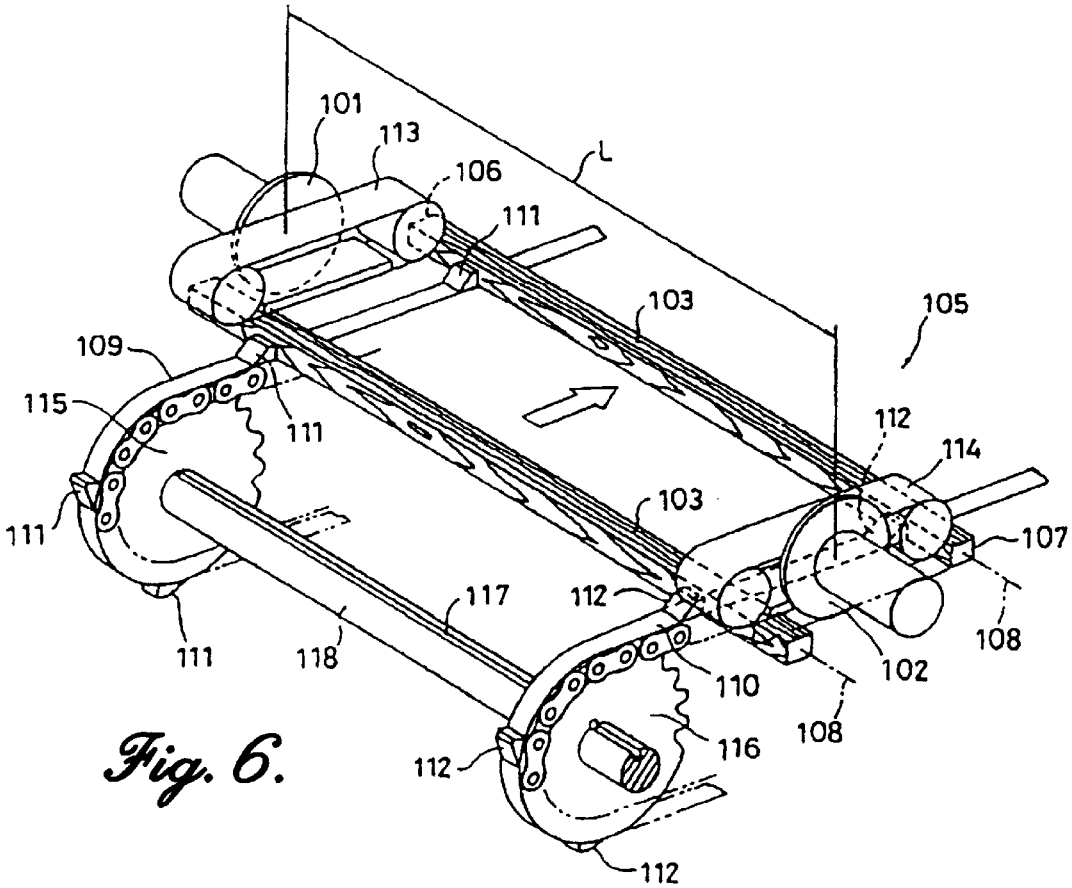
FIG. 6 is a perspective view schematically showing a prior art apparatus.
Figure 7A:
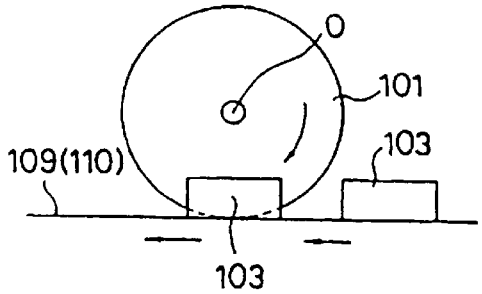
FIGS. 7(*a*) and 7(*b*) are schematic diagrams illustrating a prior art method for cutting a finished building material product of a predetermined length in side and top plan views, respectively.
Figure 7B:
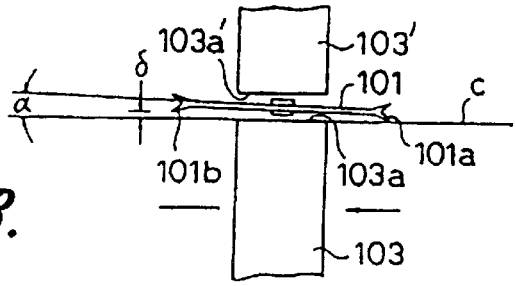

FIG. 5 shows an angle adjusting mechanism 15 for cutter heads in alternate embodiments of the invention. While the desired effect may be achieved even when only one of the cutter heads 3, 5, 6, 7 is provided with the angle adjusting mechanism 15 as will be described below, it is preferred to associate an angle adjusting mechanisms 15 with each of the cutter heads.

The angle adjusting mechanism 15 is for rotating the center line of a circular saw 16*b* of a cutter head 16 so that a workpiece can be cut at a predetermined angle relative to the longitudinal axis of the work piece. Each angle adjusting mechanism 15 includes a guide frame 17 of a semicircular-arc-shape adapted to be engaged with the associated cutter head 16, and a clamp 18 provided on the associated cutter head 16. The guide frame 17 includes an angular scale 17*a* and an indicator line 16*a* on the cutter head 16 for indicating a predetermined angular position. The circular saw 16*b* associated with the cutter head 16 can be adjustably rotated about a diagonal 16*c* of the circular saw 16*b*, wherein the diagonal is substantially vertical to the conveying plane. After the circular saw 16*b* has been rotated to the proper angle, it can be clamped in place using the clamp 18. Thus, the angle adjusting mechanism 15 allows workpiece to be obliquely cut at a given angle, while maintaining predetermined center-to-center distances between cutting planes of the cutter heads.

Frequently, it is necessary to obliquely cut a workpiece, such as when constructing a stile and a rail that connect together to form a framework. The angle adjusting mechanism 15 advantageously permits a workpiece to be cut to the proper length, having obliquely cut ends in a single operation, rather than requiring reshaping of the cut ends of an orthogonally cut work piece.

As will be appreciated, the invention provides a number of advantages. For example, the invention allows a plurality of products to be cut from a workpiece in a single operation by providing a plurality of cutter heads along a carry-in conveyor, and permitting adjacent cutting heads to be adjustably spaced from each other. Additionally, one or more of the cutters heads may be retracted to prevent the cutter head from cutting the workpiece, or advanced to cut the workpiece to increase decrease or increase, respectively, the number of products cut from the workpiece. In alternate embodiments, an angle adjusting mechanism for the cutter heads permits the cutting plane to be adjustably angled relative to the longitudinal axis of the workpiece so that the workpiece may be cut at an angle to form products having obliquely cut end(s) in a single operation.

Further, the invention provides switching mechanisms for transferring a workpiece from the carry-in conveyor to transfer conveyors. The switching mechanism allows the carry-in conveyor to be located at an appropriate distance from the transfer conveyors and thereby allows a degree of freedom to be increased.

Also, the invention provides a feed mechanism including a lifting frame extending substantially parallel to the carry-in conveyor, and a pair of air cylinders for raising and lowering the lifting frame. The feed mechanism vertically lifts the workpiece towards the rotational axis of each of the circular saws of the cutter heads so that cutting completes before the workpiece reaches the rotational axis of each circular saw. This arrangement is extremely advantageous because the arrangement obtains products having smoothly cut ends. The ends of such products can thereafter be bonded to the ends of other products with adhesives to achieve a high-strength bond. Additionally, the feed mechanism advantageously facilitates moving the entire workpiece upward or downward at a uniform rate towards the circular saws.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A cutting machine for cutting an elongate workpiece having first and second ends, comprising:

(a) a frame;

(b) a first cutting mechanism supported on the frame and defining a first rotational axis;

(c) a second cutting mechanism defining a second rotational axis and supported on the frame and spaced from the first cutting mechanism;

(e) a transfer conveyor supported on the frame for conveying the workpiece along a first path of travel, the first path of travel including a location that is adjacent to the first and second cutting mechanisms;

(f) a feeding device supported on the frame for receiving the workpiece from the location on the transfer conveyor and moving the workpiece along a second path of travel which includes the location and the first and second cutting mechanisms so that a workpiece on the feeding device is moved along the second path of travel so that the workpiece contacts the cutting mechanisms to cut the workpiece in two locations, the second path of travel extending along a plane extending through an axis extending through the first rotational axis;

(g) a plurality of transfer conveyors for moving the workpiece along the first path of travel for receipt by the feeding device, a first one of the transfer conveyors being slidably mounted to the frame so that sliding the first one of the transfer conveyors moves the first one of the transfer conveyors in a direction orthogonal to the first path of travel; and (h) an input conveyor supported on the frame for conveying the workpiece to the transfer conveyor and a switching mechanism having an air cylinder for shifting the workpiece from the input conveyor to the transfer conveyors.

2. The cutting machine of claim 1, wherein the second cutting mechanism is slidably mounted to the frame so that sliding of the second cutting mechanism moves the second cutting mechanism toward and away from the first cutting mechanism.

3. The cutting machine of claim 1, further comprising at least one stop, movable between a lower limit in which the stop is removed from the first path of travel and an upper limit in which the stop is located within the first path of travel, whereby the stop prevents the transfer conveyers from moving the workpiece beyond a predetermined location when the stop is moved to the upper limit.

4. The cutting machine of claim 1, wherein the first and the second cutting mechanisms are arranged so that a workpiece held by the feeding device substantially simultaneously contacts the first and the second cutting mechanisms when the feeding device moves the workpiece along the second path of travel.

5. The cutting machine of claim 1, wherein the second path of travel substantially coincides with the second rotational axis.

6. The cutting machine of claim 1, wherein the first path of travel is substantially orthogonal to the second path of travel.

7. The cutting machine of claim 1, wherein the first cutting mechanism is rotatable to a plurality of angles for cutting the workpiece at a predetermined angle relative to a longitudinal axis of the workpiece.

8. The cutting machine of claim 7, wherein the second cutting mechanism is slidably mounted to the frame so that sliding of the second cutting mechanism moves the second cutting mechanism toward and away from the first cutting mechanism.

9. The cutting machine of claim 7, wherein the second cutting mechanism is rotatable to a plurality of angles for cutting the workpiece at a predetermined angle relative to a longitudinal axis of the workpiece.

10. The cutting machine of claim 1, further comprising an input conveyor supported on the frame for conveying the workpiece to the transfer conveyor along a third path of travel.

11. The cutting machine of claim 10, wherein the first path of travel is substantially orthogonal to the third path of travel.

12. The cutting machine of claim 11, wherein the first path of travel is substantially orthogonal to the second path of travel and the third path of travel.

13. The cutting machine of claim 1, further comprising a third cutting mechanism supported on the frame for cutting the workpiece when the feeding device moves the workpiece along the second path of travel.

14. The cutting machine of claim 13, wherein the second cutting mechanism is movable from a cutting position located along the second path of travel for cutting the workpiece, to a disengaged position removed from the second path of travel so that the second cutting mechanism does not contact the workpiece when the workpiece is moved along the second path of travel by the feeding device.

15. The cutting machine of claim 13, wherein the first, the second, and the third cutting mechanisms are arranged so that when the feeding device moves the workpiece along the second path of travel, the workpiece substantially simultaneously contacts the first, the second and the third cutting mechanisms.

16. The cutting machine of claim 13, wherein the first, the second, and the third cutting mechanisms are rotatable to a plurality of angles for cutting the workpiece at predetermined angles relative to a longitudinal axis of the workpiece.

17. The cutting machine of claim 13, wherein the third cutting mechanism defines a third rotational axis, and wherein the second path of travel substantially coincides with the second and third rotational axes.

* * * * *